US011587709B2

(12) United States Patent
Yen et al.

(10) Patent No.: US 11,587,709 B2
(45) Date of Patent: Feb. 21, 2023

(54) INDUCTOR DEVICE

(71) Applicant: Realtek Semiconductor Corporation, Hsinchu (TW)

(72) Inventors: Hsiao-Tsung Yen, Hsinchu (TW); Ka-Un Chan, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 352 days.

(21) Appl. No.: 16/823,446

(22) Filed: Mar. 19, 2020

(65) Prior Publication Data

US 2020/0312511 A1 Oct. 1, 2020

Related U.S. Application Data

(60) Provisional application No. 62/871,263, filed on Jul. 8, 2019, provisional application No. 62/826,286, filed on Mar. 29, 2019.

(30) Foreign Application Priority Data

Nov. 13, 2019 (TW) ..... 108141274

(51) Int. Cl.
*H01F 17/00* (2006.01)
*H01F 27/29* (2006.01)
*H01F 27/28* (2006.01)

(52) U.S. Cl.
CPC ..... *H01F 17/0006* (2013.01); *H01F 27/2828* (2013.01); *H01F 27/29* (2013.01); *H01F 2017/0073* (2013.01)

(58) Field of Classification Search
CPC ..... H01F 2017/0073; H01F 17/0006; H01F 27/2804; H01F 2027/2809;
(Continued)

(56) References Cited

U.S. PATENT DOCUMENTS 5,420,558 A 5/1995 Ito et al.
9,312,060 B2 4/2016 Godoy et al.
(Continued)

FOREIGN PATENT DOCUMENTS

CN 104769687 A 7/2015
CN 108022913 A 5/2018
(Continued)

OTHER PUBLICATIONS

China Patent Office, Office Action of the corresponding Chinese application No. 201911129792.1 dated Mar. 29, 2021.
(Continued)

*Primary Examiner* — Ryan Johnson
(74) *Attorney, Agent, or Firm* — Locke Lord LLP; Tim Tingkang Xia, Esq.

(57) ABSTRACT

An inductor device includes a first wire, a second wire, an input terminal, a third wire, a fourth wire, and an eight-shaped inductor structure. The first wire is disposed in a first area. The second wire is disposed in a second area. The input terminal is disposed on a first side of the second area. The third wire is disposed in the first area and at least partially
(Continued)

overlapped with the first wire in a vertical direction, in which the third wire is coupled to the first wire. The fourth wire is disposed in the second area and at least partially overlapped with the second wire in the vertical direction, in which the fourth wire is coupled to the second wire. The eight-shaped inductor structure is disposed on an outer side of the third wire and the fourth wire.

20 Claims, 7 Drawing Sheets

(58) Field of Classification Search
CPC ..... H01F 2017/004; H01F 17/0013; H01F 27/006; H01F 27/29; H01F 2027/2819
See application file for complete search history.

(56) References Cited

U.S. PATENT DOCUMENTS

| | | | |
|---|---|---|---|
| 10,186,364 | B2 | 1/2019 | Yen et al. |
| 10,374,571 | B2 | 8/2019 | Wang et al. |
| 2017/0098500 | A1 | 4/2017 | Yen et al. |
| 2018/0330872 | A1 | 11/2018 | Yen et al. |
| 2019/0148479 | A1 | 5/2019 | Yen et al. |
| 2019/0221350 | A1 | 7/2019 | Yen et al. |
| 2019/0279809 | A1 | 9/2019 | Yen |
| 2019/0392980 | A1 | 12/2019 | Yen |
| 2020/0234864 | A1* | 7/2020 | Elzinga ..... H03L 7/093 |

FOREIGN PATENT DOCUMENTS

| | | | |
|---|---|---|---|
| CN | 108962563 | A | 12/2018 |
| JP | 2010154517 | A | 7/2010 |
| TW | 201428783 | A | 7/2014 |
| TW | 201703070 | A | 1/2017 |
| TW | I591800 | B | 7/2017 |
| TW | I643216 | B | 12/2018 |
| TW | I643217 | B | 12/2018 |

OTHER PUBLICATIONS

China Patent Office, Office Action of the related Chinese application No. 202010099915.8 dated Mar. 31, 2021.
China Patent Office, Office Action of the related Chinese application No. 202010099595.6 dated Mar. 29, 2021.
China Patent Office, Office Action of the related Chinese application No. 202010099604.1 dated Mar. 29, 2021.
China Patent Office, Office Action of the corresponding Chinese application No. 202010171503.0 dated Mar. 30, 2021.

* cited by examiner

120

INDUCTOR DEVICE

CROSS-REFERENCE TO RELATED APPLICATION

This application claims priority to and the benefit of U.S. Provisional Patent Application No. 62/826,286, filed on Mar. 29, 2019, U.S. Provisional Patent Application No. 62/871,263, filed on Jul. 8, 2019, and Taiwan Application Serial Number 108141274, filed on Nov. 13, 2019, the entire contents of which are incorporated herein by reference as if fully set forth below in its entirety and for all applicable purposes.

BACKGROUND

Field of Disclosure

The disclosure generally relates to an electronic device, and more particularly, to an inductor device.

Description of Related Art

The various types of inductors according to the prior art have their advantages and disadvantages. For example, a spiral inductor has a higher Q value and a larger mutual inductance. However, its mutual inductance value and coupling are both occurred between the coils. For an eight-shaped inductor which has two sets of coils, the coupling between the two sets of coils is relatively low. However, an eight-shaped inductor occupies a larger area in a device. In addition, although a traditional stacked eight-shaped inductor has better symmetry, its inductance value per unit area is lower. Therefore, the scopes of application of the above inductors are limited.

SUMMARY

The foregoing presents a simplified summary of the disclosure in order to provide a basic understanding to the reader. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later.

One objective of the present disclosure is to provide an inductor device to resolve the problems of the prior art. The means of solution are described as follows.

One aspect of the present disclosure is to provide an inductor device. The inductor device includes a first wire, a second wire, an input terminal, a third wire, a fourth wire, and an eight-shaped inductor structure. The first wire is disposed in a first area. The second wire is disposed in a second area. The input terminal is disposed on a first side of the second area. The third wire is disposed in the first area and at least partially overlapped with the first wire in a vertical direction, and the third wire is coupled to the first wire. The fourth wire is disposed in the second area and at least partially overlapped with the second wire in the vertical direction, and the fourth wire is coupled to the second wire. The eight-shaped inductor structure is disposed on an outer side of the third wire and the fourth wire.

Therefore, based on the technical content of the present disclosure, the inductor device adopting the structure according to the embodiment of the present disclosure has a better inductance value per unit area.

It is to be understood that both the foregoing general description and the following detailed description are by examples, and are intended to provide further explanation of the disclosure as claimed.

DETAILED DESCRIPTION

Figure 1:
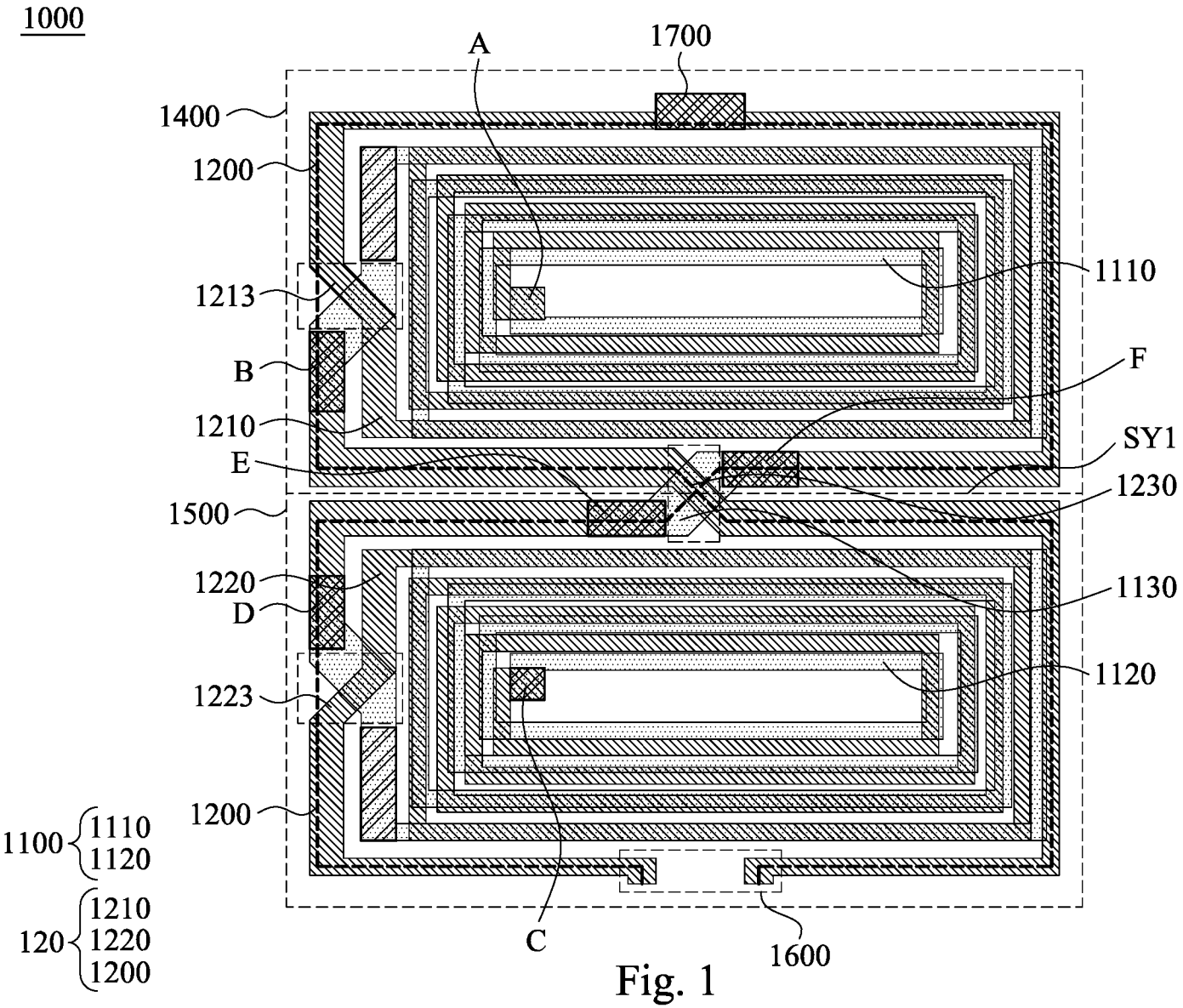
FIG. 1 is a schematic diagram illustrating an inductor device in accordance with some embodiments of the present disclosure.

Reference is made to FIG. 1, which is a schematic diagram illustrating an inductor device 1000 in accordance with some embodiments of the present disclosure. As shown in FIG. 1, the inductor device 1000 includes a first wire 1110, a second wire 1120, a third wire 1210, a fourth wire 1220, and an eight-shaped inductor structure 1200. The eight-shaped inductor structure 1200 is an outermost wire of the inductor device 1000 (shown by the dotted line). That is to say, the eight-shaped inductor structure 1200 is disposed on the outer of the third wire 1210 and the fourth wire 1220. The first wire 1110 and the second wire 1120 are partially overlapped with the third wire 1210 and the fourth wire 1220, and the first wire 1110 and the second wire 1120 are disposed inside the eight-shaped inductor structure 1200. The first wire 1110, the second wire 1120, the third wire 1210, and the fourth wire 1220 can be wires designed different from each other. In one embodiment, the first wire 1110, the second wire 1120, the third wire 1210, and the fourth wire 1220 can be a spiral stacked inductor, a symmetric stacked inductor, a spiral inductor, a symmetric inductor, and so on. However, the present disclosure is not limited to the inductor provided above.

Figure 2:
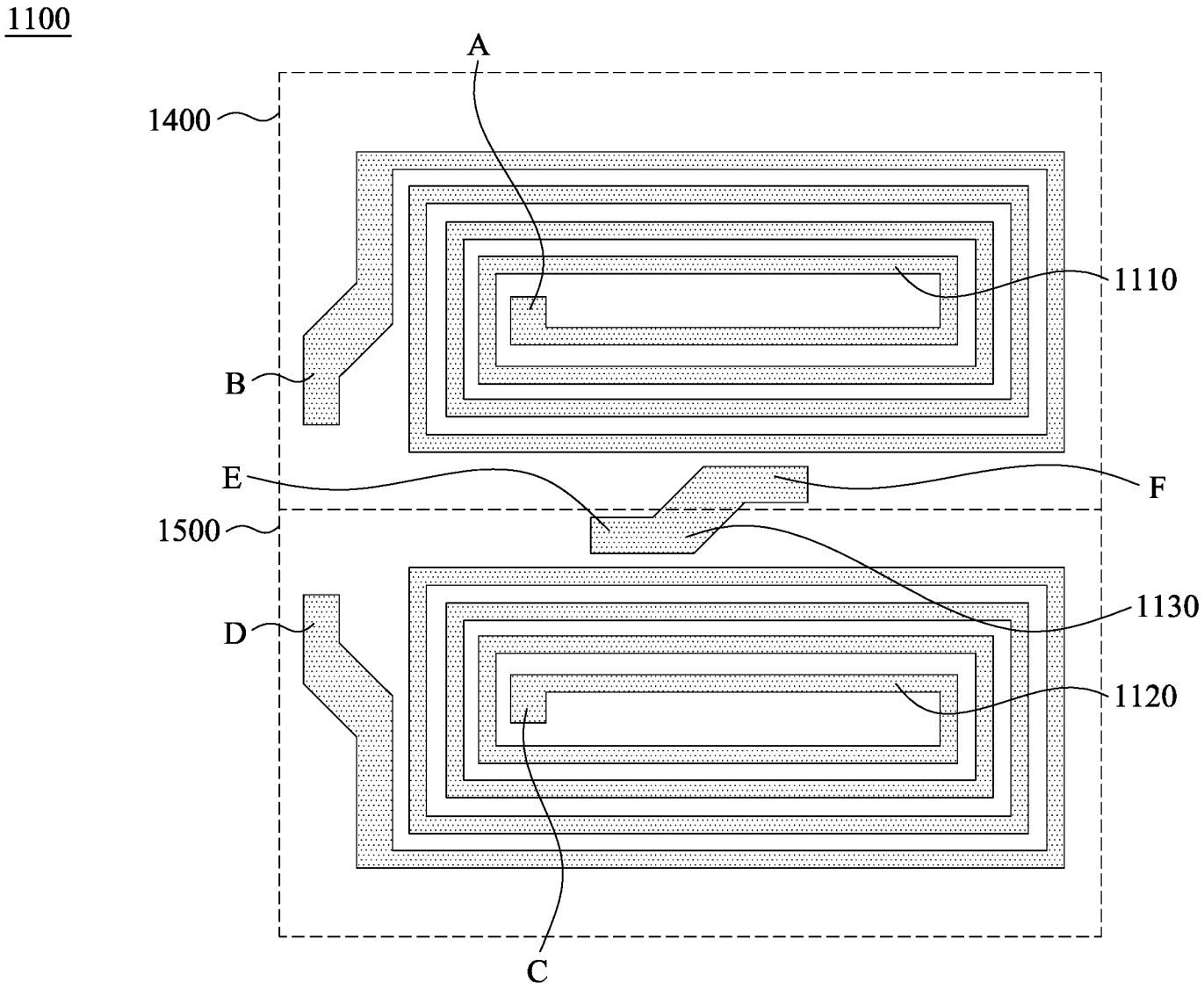
FIG. 2 is a schematic diagram illustrating a partial structure of the inductor device in FIG. 1 in accordance with some embodiments of the present disclosure.
Figure 3:
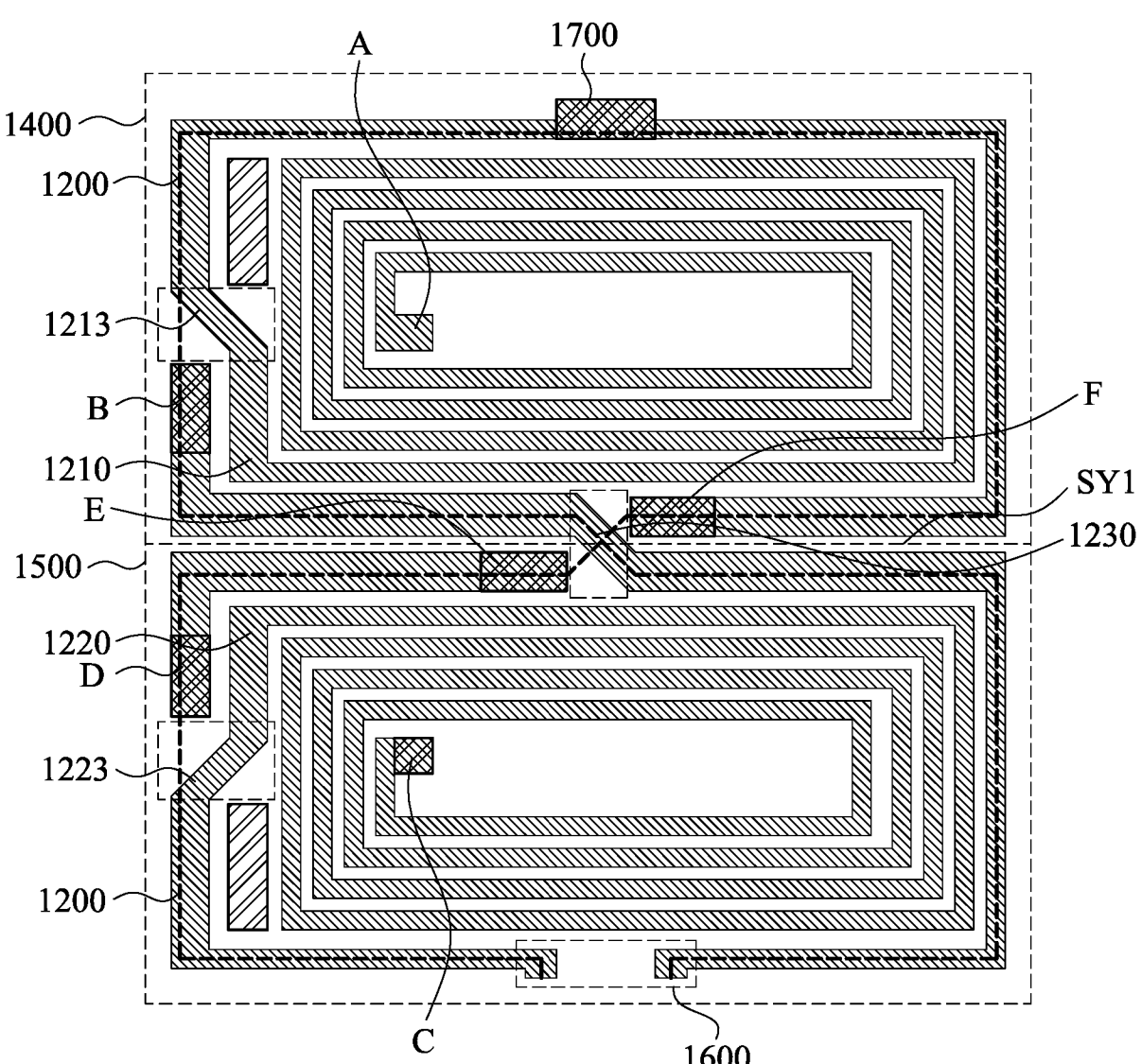
FIG. 3 is a schematic diagram illustrating a partial structure of the inductor device in FIG. 1 in accordance with some embodiments of the present disclosure.

To facilitate understanding of the present disclosure, the inductor device 1000 shown in FIG. 1 is divided into a partial structure 1100 of the inductor device 1000 shown in FIG. 2 and a partial structure 120 of the inductor device 1000 shown in FIG. 3. The partial structure 120 includes the eight-shaped inductor structure 1200, the third wire 1210, and the fourth wire 1220.

Reference is made to FIGS. 1-3. The first wire 1110 is disposed in a first area 1400, and the second wire 1120 is disposed in a second area 1500. For example, the first area 1400 is located on an upper side of the inductor device 1000, and the second area 1500 is located on a lower side of the inductor device 1000. In addition, the first wire 1110, the second wire 1120, the third wire 1210 and the fourth wire 1220, which are stacked in a center portion of the first area 1400 and the second area 1500 in FIGS. 2-3, are mirrored symmetry or have an up-and-down shift and duplicated relation. Therefore, the relation can make the inductor device 1000 have symmetry features and brings the merits of easy design. The detailed structure and connecting relation will be described hereinafter.

Reference is made to FIGS. 1-3. The third wire 1210 is disposed in the first area 1400 and at least partially overlapped with the first wire 1110 in a vertical direction. That is to say, the third wire 1210 is disposed above or below the first wire 1110, and the third wire 1210 is coupled to the first wire 1110.

In one embodiment, a first terminal of the first wire 1110 is disposed in the inner wire of the first wire 1110. A first terminal of the third wire 1210 is disposed in the inner wire of the third wire 1210. The first terminal of the first wire 1110 and the first terminal of the third wire 1210 are coupled at a connection point A.

In one embodiment, the third wire 1210 is partially overlapped with the first wire 1110 in a direction which is vertical to the third wire 1210. In other words, in a top-view direction of the inductor device 1000, the third wire 1210 is partially overlapped with the first wire 1110. The first wire 1110 is coupled with the third wire 1210 through a vertical connecting piece (i.e., a via) at the connection point A in the top-view direction of the inductor device 1000. In another embodiment, the third wire 1210 is substantially overlapped with the first wire 1110 in the direction which is vertical to the third wire 1210.

In one embodiment, a second terminal of the first wire 1110 (located in the outer wire of the first wire 1110) and the eight-shaped inductor structure 1200 are coupled at a connection point B. The first wire 1110 is coupled with the eight-shaped inductor structure 1200 through a vertical connecting piece at the connection point B in a top-view direction of the inductor device 1000.

In one embodiment, the fourth wire 1220 is disposed in the second area 1500 and at least partially overlapped with the second wire 1120 in a direction which is vertical to the second wire 1120. That is to say, the fourth wire 1220 is disposed above or below the second wire 1120, and the fourth wire 1220 is coupled to the second wire 1120.

In one embodiment, a first terminal of the second wire 1120 is located in the inner wire of the second wire 1120. A first terminal of the fourth wire 1220 is located in the inner wire of the fourth wire 1220. The first terminal of the second wire 1120 and the first terminal of the fourth wire 1220 are coupled at a connection point C.

In one embodiment, the fourth wire 1220 is partially overlapped with the second wire 1120 in a direction which is vertical to the fourth wire 1220. In other words, the fourth wire 1220 is partially overlapped with the second wire 1120 in a top-view direction of the inductor device 1000. The second wire 1120 and the fourth wire 1220 are coupled through a vertical connecting piece at the connection point C in the top-view direction of the inductor device 1000. In another embodiment, the fourth wire 1220 is substantially overlapped with the second wire 1120 in a direction which is vertical to the fourth wire 1220.

In one embodiment, a second terminal of the second wire 1120 (located in the outer wire of the second wire 1120) and the eight-shaped inductor structure 1200 are coupled at a connection point D. The second wire 1120 and the eight-shaped inductor structure 1200 are coupled through a vertical connecting piece at the connection point D in a top-view direction of the inductor device 1000.

In one embodiment, the first wire 1110 and the second wire 1120 are approximately symmetrical with each other. The third wire 1210 and the fourth wire 1220 are approximately symmetrical with each other. For example, the first wire 1110 and the second wire 1120 are approximately symmetrical with each other based on a symmetry axis SY1. The third wire 1210 and the fourth wire 1220 are approximately symmetrical with each other based on the symmetry axis SY1.

In one embodiment, the eight-shaped inductor structure 1200 includes a crossing portion 1213 which is located on a second side of the first area 1400 (i.e., the left side) and a crossing portion 1223 which is located on a second side of the second area 1500 (i.e., the left side). As shown in FIG. 1 and FIG. 3, the eight-shaped inductor structure 1200 is coupled with the second terminal of the third wire 1210 (located in the outer wire of the third wire 1210) through the crossing portion 1213, and the eight-shaped inductor structure 1200 is coupled with the second terminal of the fourth wire 1220 (located in the outer wire of the fourth wire 1220) through the crossing portion 1223, such that the third wire 1210 and the fourth wire 1220 are located inside the eight-shaped inductor structure 1200.

In one embodiment, the inductor device 1000 further includes a connecting piece 1130 (as shown in FIG. 2). The connecting piece 1130 is disposed above or below the eight-shaped inductor structure 1200. The connecting piece 1130 and a crossing portion 1230 are disposed in a junction of the first area 1400 and the second area 1500 in order to be coupled between an upper-half portion of the eight-shaped inductor structure 1200 and a lower-half portion of the eight-shaped inductor structure 1200, such that the eight-shaped inductor structure 1200 forms an eight-shaped circuit.

In one embodiment, the inductor device 1000 further includes an input terminal 1600, and the input terminal 1600 is disposed on a first side of the second area 1500 (such as a lower side in FIG. 1), which is another side opposite to the junction. Furthermore, the inductor device 1000 further includes a center-tapped terminal 1700, and the center-tapped terminal 1700 is disposed on a third side of the first area 1400 (such as an upper side in FIG. 1), which is another side opposite to the junction. In one embodiment, the input terminal 1600 and the center-tapped terminal 1700 are disposed above the eight-shaped inductor structure 1200.

Reference is made to FIG. 3. The third wire 1210 and the fourth wire 1220 are located on a same layer. In one embodiment, the third wire 1210 and the fourth wire 1220 can be configured to join together as the eight-shaped inductor structure 1200. The third wire 1210 and the fourth wire 1220 are not limited to the structure shown in FIG. 3, and shapes and numbers of windings of the third wire 1210 and the fourth wire 1220 may be configured depending on practical needs. Furthermore, reference is made again to FIGS. 1-3. Because the third wire 1210 is disposed above the first wire 1110 and the first wire 1110 and the second wire 1120 are located on the same layer, the third wire 1210 is located on a different layer from the second wire 1120. Furthermore, because the fourth wire 1220 is disposed above the second wire 1120 and the first wire 1110 and the second wire 1120 are located on the same layer, the fourth wire 1220 is located on a different layer from the first wire 1110.

Reference is made to FIGS. 1-3. When a signal is input into one terminal of the input terminal 1600 (i.e., the left terminal), the signal is transmitted in the lower-half portion of the eight-shaped inductor structure 1200, the crossing portion 1223, and the fourth wire 1220 in a first direction (i.e., the clockwise direction). The signal is transmitted from the fourth wire 1220 to the second wire 1120 at the connection point C, and then is transmitted in the second wire 1120 in the first direction (i.e., the clockwise direction). Furthermore, the signal is transmitted from the second wire 1120 through the connection point D to the eight-shaped inductor structure 1200. One terminal of the connecting piece 1130 (i.e., a connection point E) is coupled to the lower-half portion of the eight-shaped inductor structure 1200, and another terminal of the connecting piece 1130 (i.e., a connection point F) is coupled to the upper-half portion of the eight-shaped inductor structure 1200. Therefore, the signal is transmitted from the lower-half portion of the eight-shaped inductor structure 1200 through the connecting piece 1130 to the upper-half portion of the eight-shaped inductor structure 1200.

The signal is transmitted in the upper-half portion of the eight-shaped inductor structure 1200, the crossing portion 1213, and the third wire 1210 in a second direction (i.e., the counterclockwise direction). The signal is transmitted from the third wire 1210 to the first wire 1110 at the connection point A, and is transmitted in the first wire 1110 in the second direction (i.e., the counterclockwise direction). Subsequently, the signal is transmitted from the first wire 1110 through the connection point B to the eight-shaped inductor structure 1200. The signal is transmitted through the crossing portion 1230 to the lower-half portion of the eight-shaped inductor structure 1200, and output to another terminal of the input terminal 1600 (i.e., the right terminal).

Figure 4:
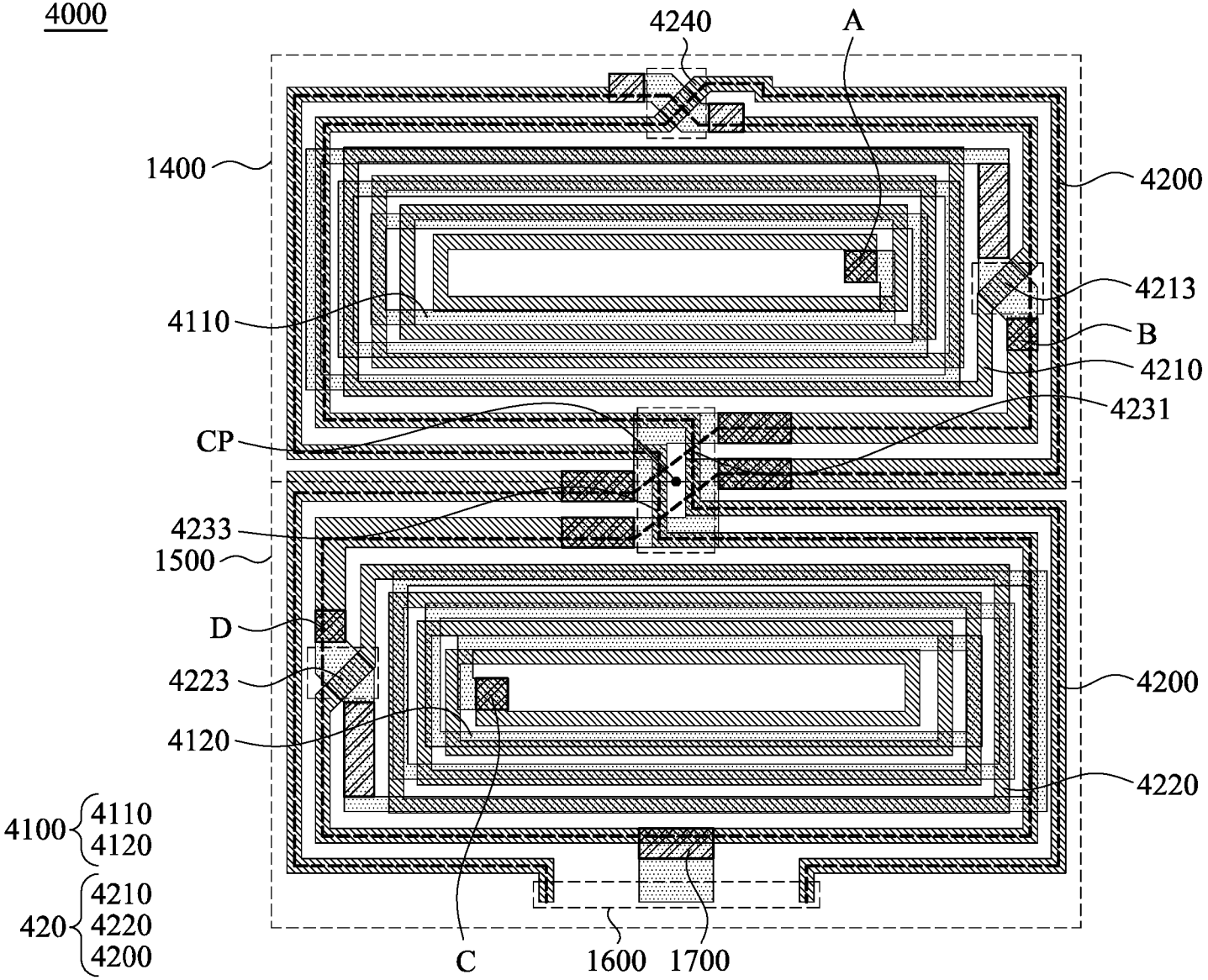
FIG. 4 is a schematic diagram illustrating an inductor device in accordance with some embodiments of the present disclosure.

FIG. 4 is a schematic diagram illustrating an inductor device 4000 in accordance with some embodiments of the present disclosure. As shown in FIG. 4, the inductor device 4000 includes a first wire 4110, a second wire 4120, a third wire 4210, a fourth wire 4220, and an eight-shaped inductor structure 4200. The eight-shaped inductor structure 4200 is an outermost wire of the inductor device 4000. In one embodiment, the eight-shaped inductor structure 4200 is two outermost wires of the inductor device 4000 (shown by the dotted line). The first wire 4110, the second wire 4120, the third wire 4210, and the fourth wire 4220 are the wires located inside the eight-shaped inductor structure 4200 and/or not beyond the outer wires of the eight-shaped inductor structure 4200.

Figure 5:
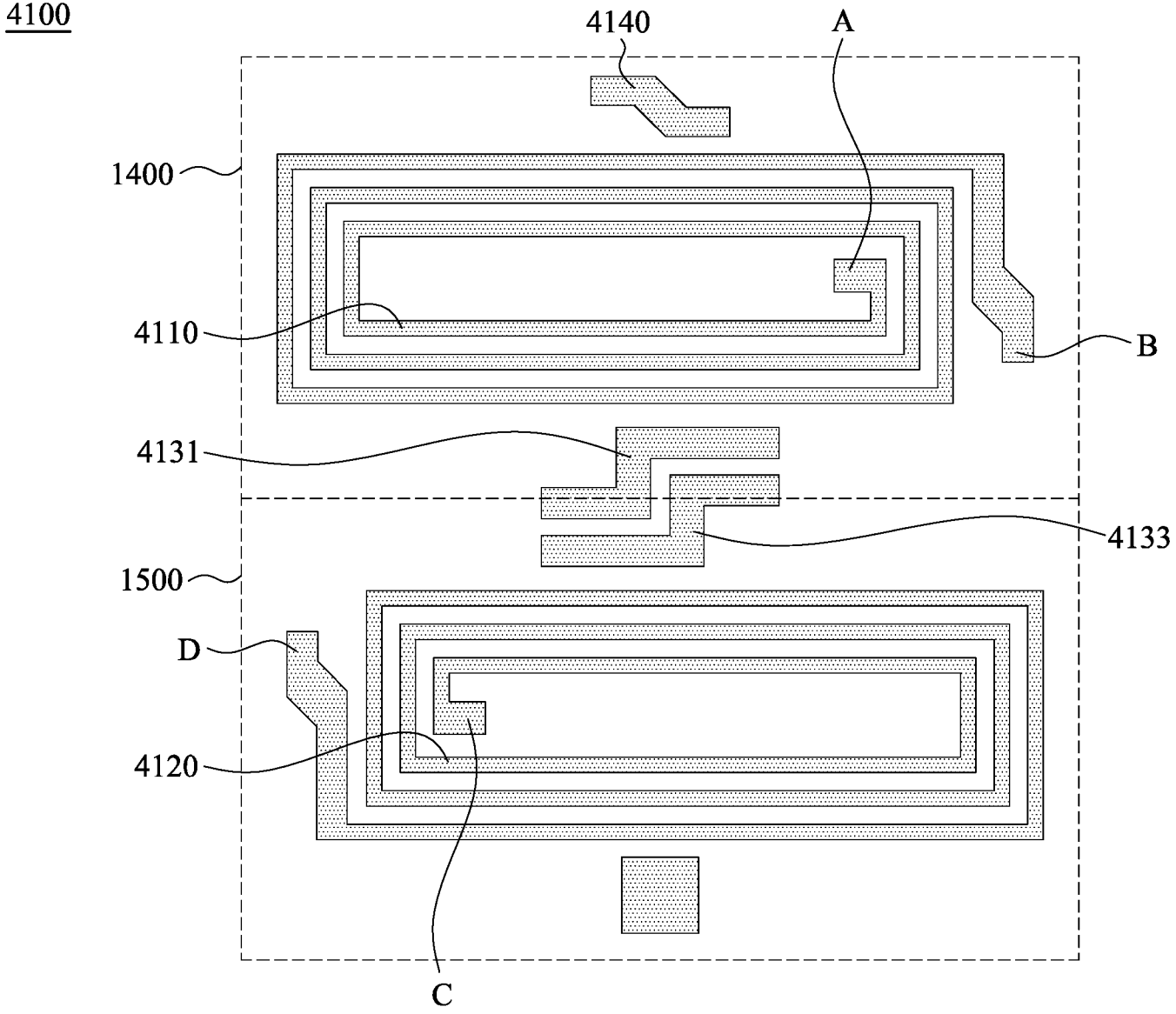
FIG. 5 is a schematic diagram illustrating a partial structure of the inductor device in FIG. 4 in accordance with some embodiments of the present disclosure.
Figure 6:
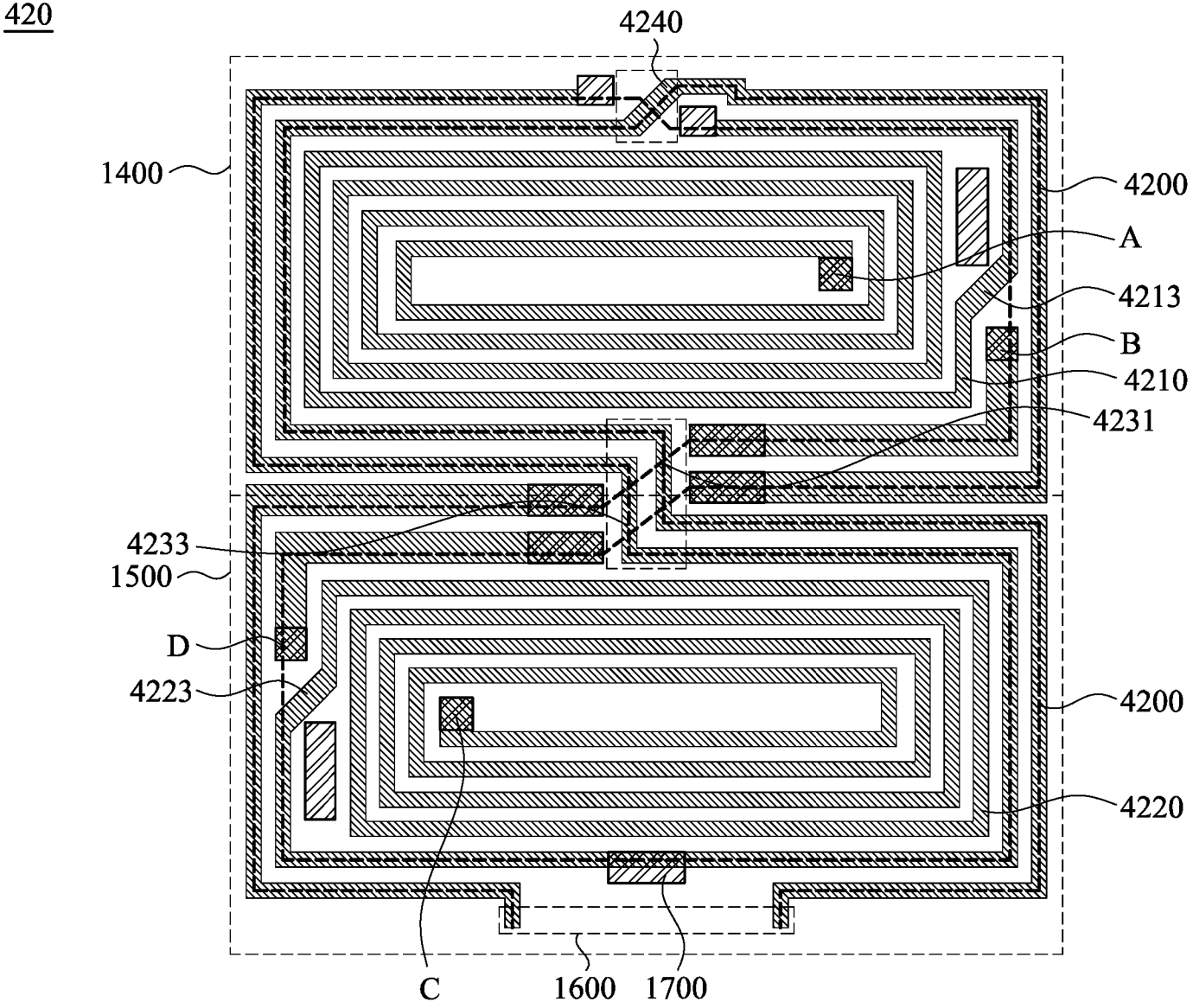
FIG. 6 is a schematic diagram illustrating a partial structure of the inductor device in FIG. 4 in accordance with some embodiments of the present disclosure.

To facilitate understanding of the present disclosure, the inductor device 4000 shown in FIG. 4 is divided into a partial structure 4100 of the inductor device 4000 shown in FIG. 5 and a partial structure 420 of the inductor device 4000 shown in FIG. 6. The partial structure 420 includes the eight-shaped inductor structure 4200, the third wire 4210, and the fourth wire 4220.

Reference is made to FIGS. 4-6. The first wire 4110 is disposed in a first area 1400, and the second wire 4120 is disposed in a second area 1500. It should be noted that the elements shown FIGS. 4-6, whose numbers are the same as the numbers of the elements shown in FIGS. 1-3, have the same connections, functions or related descriptions in connection with those elements shown in FIGS. 1-3, and the connections, functions or related descriptions regarding the elements shown FIGS. 4-6 will be omitted here for the sake of brevity.

Reference is made to FIGS. 4-6. The third wire 4210 is disposed in the first area 1400 and at least partially overlapped with the first wire 4110 in a direction which is vertical to the first wire 4110. That is to say, the third wire 4210 is disposed above or below the first wire 4110, and the third wire 4210 is coupled to the first wire 4110. Similarly, the fourth wire 4220 is disposed in the second area 1500 and at least partially overlapped with the second wire 4120 in a direction which is vertical to the second wire 4120. That is to say, the fourth wire 4220 is disposed above or below the second wire 4120, and the fourth wire 4220 is coupled to the second wire 4120.

In one embodiment, the eight-shaped inductor structure 4200 includes a crossing portion 4213 located on a fourth side of the first area 1400 (i.e., the right side) and a crossing portion 4223 located on a second side of the second area 1500 (i.e., the left side). The fourth side of the first area 1400 is different from the second side of the second area 1500. As shown in FIG. 4, the eight-shaped inductor structure 4200 is coupled to the third wire 4210 through the crossing portion 4213, and the eight-shaped inductor structure 4200 is coupled to the fourth wire 4220 through the crossing portion 4223, such that the third wire 4210 and the fourth wire 4220 are located inside the eight-shaped inductor structure 4200.

In one embodiment, the eight-shaped inductor structure 4200 is coupled at a third side of the first area 1400 (i.e., the upside) in an interlaced manner. An extension direction of the third side of the first area 1400 is vertical to an extension direction of the fourth side of the first area 1400 (i.e., the right side). The third wire 4210 has a crossing portion 4240 (as shown in FIG. 6) on the third side of the first area 1400 (i.e., the upside). In addition, the inductor device 4000 further includes a connecting piece 4140 (as shown in FIG. 5), such that the connecting piece 4140 is coupled to two outermost wires of the eight-shaped inductor structure 4200.

In one embodiment, the inductor device 4000 further includes a connecting piece 4131 and a connecting piece 4133 (as shown in FIG. 5). The connecting piece 4131 and the connecting piece 4133 are disposed above the eight-shaped inductor structure 4200 or below the eight-shaped inductor structure 4200. The connecting piece 4131, the connecting piece 4133, the crossing portion 4231, and the crossing portion 4233 are disposed in a junction of the first area 1400 and the second area 1500 in order to be coupled between the upper-half portion of the eight-shaped inductor structure 4200 and the lower-half portion of the eight-shaped inductor structure 4200, such that the eight-shaped inductor structure 4200 forms an eight-shaped circuit.

In one embodiment, the inductor device 4000 further includes an input terminal 1600 and a center-tapped terminal 1700. The input terminal 1600 and the center-tapped terminal 1700 are disposed on the first side of the second area 1500 (i.e., the lower side in FIG. 4), and the first side is opposite to the junction. In other words, the input terminal 1600 and the center-tapped terminal 1700 are disposed on the same side of the inductor device 4000. In one embodiment, the input terminal 1600 and the center-tapped terminal 1700 are disposed above the eight-shaped inductor structure 4200.

In one embodiment, the first wire 4110 and the second wire 4120 are located on a same layer, and the third wire 4210 and the fourth wire 4220 are located on a same layer. Because the third wire 4210 is disposed above the first wire 4110 and the fourth wire 4220 is disposed above the second wire 4120, the third wire 4210 is disposed in a different layer from the second wire 4120 and the fourth wire 4220 is disposed in a different layer from the first wire 4110.

In one embodiment, the inductor device 4000 has a bevel symmetry structure. As shown in FIG. 4, after the inductor device 4000 is rotated around a central point CP with 180 degrees, the structure of the first area 1400 which is rotated is approximately the same with the structure of the second area 1500. Similarly, the structure of the second area 1500 which is rotated is approximately the same with structure of the first area 1400.

Figure 7:
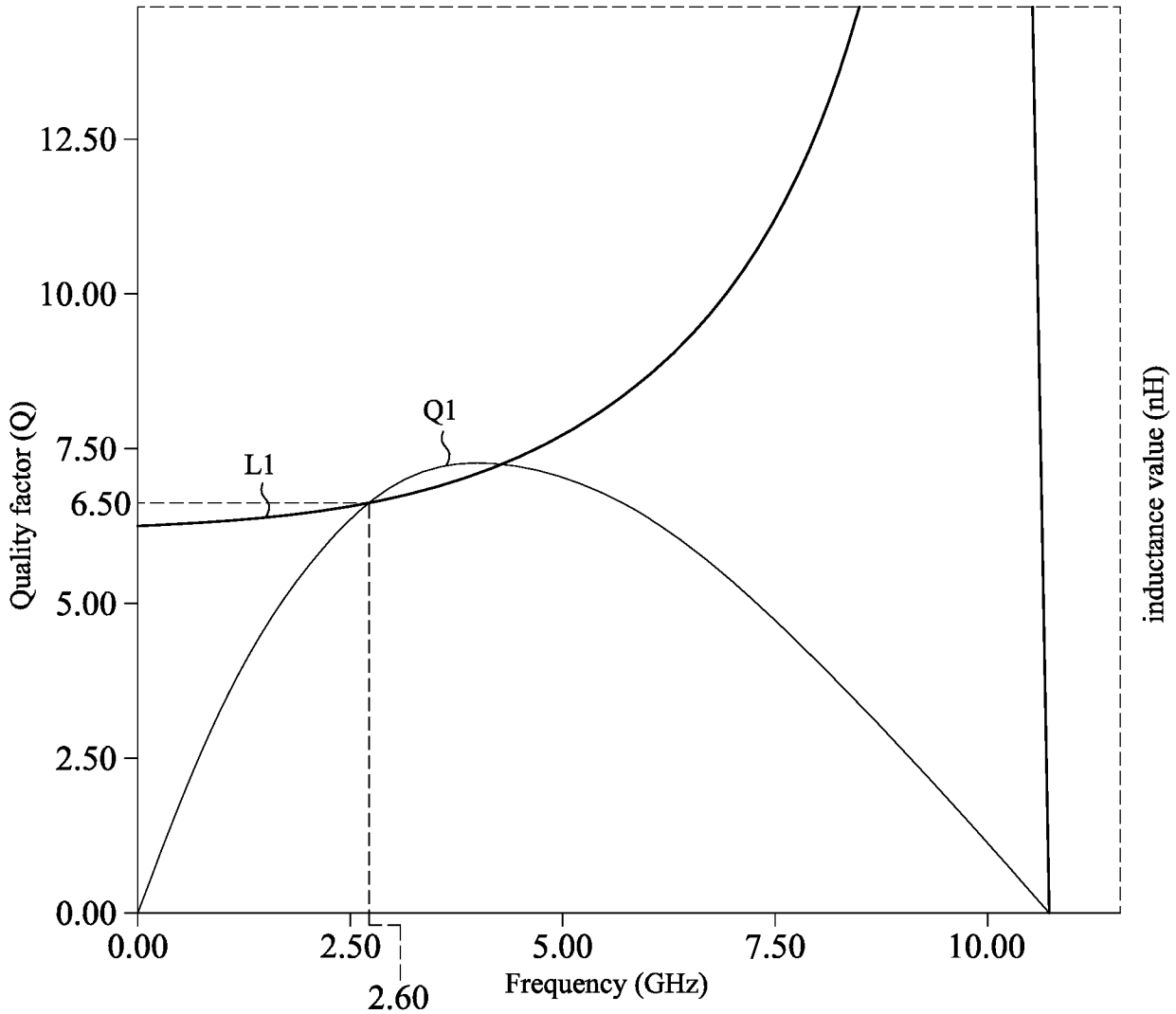
FIG. 7 illustrates the experimental data of the inductor device according to one embodiment of the present disclosure.

FIG. 7 illustrates the experimental data of the inductor device according to one embodiment of the present disclosure. As shown in the figure, the experimental curve of the quality factor of the inductor device adopting the structural configuration of the present disclosure is Q1 and the experimental curve of the inductance value is L1, and the value of the curve L1 (i.e., the inductance value nH) is referred to as the value of the curve Q1 (i.e., the quality factor, as the Y-axis value on the left side shown in FIG. 7). As can be seen from the figure, the inductor device 1000 in FIG. 1 adopting the structure of the present disclosure has a better inductance value per unit area. For example, in a case of the inductor device 1000 has an area of 90 um*90 um, the inductance value is up to about 6.5 nH at the frequency 2.6 GHz as shown at the curve L1, and the quality factor (Q) is about 6.5 at the frequency 2.6 GHz as shown at the curve Q1. In addition, in a case of the inductor device 4000 in FIG. 4 has an area of 95 um*95 um, the inductance value is up to about 7.0 nH at the frequency 2.6 GHz, and the quality factor (Q) is about 6.2 at the frequency 2.6 GHz.

It can be understood from the embodiments of the present disclosure that application of the present disclosure has the following advantages. The inductor device adopting the structure of the present disclosure has a symmetrical structure, and the coupling on the left-and-right side of the inductor device and the coupling on the upper-and-lower layers are generated. The inductor device adopting the structure of the present disclosure provides the inductance value of differential mode and minimizes the inductance value of common mode. Therefore, the inductor device of the present disclosure provides a better inductance value per unit area.

What is claimed is:

1. An inductor device, comprising:

a first wire disposed in a first area;

a second wire disposed in a second area; an input terminal disposed on a first side of the second area;

a third wire disposed in the first area, wherein a plurality portions of the third wire overlap with a plurality portions of the first wire in a vertical direction and are parallel in a horizontal direction, and the vertical direction is perpendicular to a layer where the first wire is located, wherein the third wire is coupled to the first wire;

a fourth wire disposed in the second area, wherein a plurality portions of the fourth wire overlap with a plurality portions of the second wire in the vertical direction and are parallel in the horizontal direction, wherein the fourth wire is coupled to the second wire; and an eight-shaped inductor structure disposed on an outer side of the third wire and the fourth wire.

2. The inductor device of claim 1, wherein the eight-shaped inductor structure and the third wire are coupled in a first crossing portion of the first area.

3. The inductor device of claim 2, wherein the eight-shaped inductor structure and the fourth wire are coupled in a second crossing portion of the second area.

4. The inductor device of claim 1, wherein a first terminal of the first wire is disposed in an inner wire of the first wire, and a first terminal of the third wire is disposed in an inner wire of the third wire, wherein the first terminal of the third wire and the first terminal of the first wire are coupled at a first connection point.

5. The inductor device of claim 1, wherein a second terminal of the first wire is disposed in an outer wire of the first wire, and the second terminal of the first wire and the eight-shaped inductor structure are coupled at a second connection point.

6. The inductor device of claim 1, wherein a first terminal of the second wire is disposed in an inner wire of the second wire, and a first terminal of the fourth wire is disposed in an inner wire of the fourth wire, wherein the first terminal of the second wire and the first terminal of the fourth wire are coupled at a third connection point.

7. The inductor device of claim 1, wherein a second terminal of the second wire is disposed in an outer wire of the second wire, and the second terminal of the second wire and the eight-shaped inductor structure are coupled at a fourth connection point.

8. The inductor device of claim 1, wherein the first wire and the second wire are approximately symmetrical with each other, and the third wire and the fourth wire are approximately symmetrical with each other.

9. The inductor device of claim 3, wherein the first crossing portion is disposed on a second side of the first area, and the second crossing portion is disposed on a second side of the second area, wherein the second side of the first area and the second side of the second area are disposed on a same side of the eight-shaped inductor structure.

10. The inductor device of claim 3, wherein the eight-shaped inductor structure is intersected and coupled at a junction of the first area and the second area.

11. The inductor device of claim 10, further comprising:

a center-tapped terminal disposed in a third side of the first area; and wherein the first side of the second area and the third side of the first area are disposed on two sides of the junction respectively.

12. The inductor device of claim 11, further comprising:

a connecting piece disposed above or below the eight-shaped inductor structure in the vertical direction, wherein the connecting piece is connected to an upper-half portion of the eight-shaped inductor structure and a lower-half portion of the eight-shaped inductor structure.

13. The inductor device of claim 9, wherein an extension direction of the first side of the second area is vertical to an extension direction of the second side of the second area.

14. The inductor device of claim 11, wherein an extension direction of a second side of the first area is vertical to an extension direction of the third side of the first area.

15. The inductor device of claim 3, wherein the first crossing portion is disposed on a fourth side of the first area, and the second crossing portion is disposed on a second side of the second area, wherein the fourth side of the first area and the second side of the second area are disposed on different sides of the eight-shaped inductor structure.

16. The inductor device of claim 15, wherein the eight-shaped inductor structure is intersected and coupled at a junction of the first area and the second area.

17. The inductor device of claim 16, further comprising:

a center-tapped terminal disposed on the first side of the second area.

18. The inductor device of claim 17, further comprising:

a first connecting piece disposed above or below the junction in the vertical direction, wherein the first connecting piece is coupled to an upper-half portion of the eight-shaped inductor structure and a lower-half portion of the eight-shaped inductor structure; and a second connecting piece disposed above or below the junction in the vertical direction, wherein the second connecting piece is coupled to the upper-half portion of the eight-shaped inductor structure and the lower-half portion of the eight-shaped inductor structure.

19. The inductor device of claim 1, wherein the first wire and the second wire are located on a same layer, the third wire and the fourth wire are located on a same layer, the first wire is located on a different layer from the fourth wire, and the second wire is located on a different layer from the third wire.

20. The inductor device of claim 1, wherein the eight-shaped inductor structure is an inductor wire disposed on two outermost wires of the inductor device.

* * * * *